US008537061B2

(12) United States Patent
Corwin et al.

(10) Patent No.: US 8,537,061 B2
(45) Date of Patent: Sep. 17, 2013

(54) SYSTEM AND APPARATUS FOR LOCOMOTIVE RADIO COMMUNICATIONS

(75) Inventors: Robert Mark Corwin, Erie, PA (US); Gerard Cafferty, Erie, PA (US); Timothy John Opalka, Erie, PA (US)

(73) Assignee: General Electric Company, Schenectady, NY (US)

( * ) Notice: Subject to any disclaimer, the term of this patent is extended or adjusted under 35 U.S.C. 154(b) by 527 days.

(21) Appl. No.: 12/781,315

(22) Filed: May 17, 2010

(65) Prior Publication Data

US 2011/0279337 A1 Nov. 17, 2011

(51) Int. Cl.
*H01Q 1/32* (2006.01)

(52) U.S. Cl.
USPC ..... 343/713; 343/715; 343/906

(58) Field of Classification Search
USPC ..... 343/713, 711, 712, 715, 906
See application file for complete search history.

(56) References Cited

U.S. PATENT DOCUMENTS

| | | | | |
|---|---|---|---|---|
| 5,548,835 | A | 8/1996 | Sasaki | |
| 6,339,397 | B1 | 1/2002 | Baker | |
| 6,885,854 | B2 | 4/2005 | Stewart | |
| 6,990,322 | B2 | 1/2006 | Harris et al. | |
| 7,215,291 | B2 * | 5/2007 | Nakano et al. | 343/715 |
| 7,327,320 | B2 | 2/2008 | Dejean | |
| 7,646,351 | B2 | 1/2010 | Wang et al. | |
| 7,652,630 | B2 | 1/2010 | Rosenberger et al. | |
| 2006/0077112 | A1 * | 4/2006 | Nakano et al. | 343/715 |
| 2006/0103579 | A1 * | 5/2006 | Blickle | 343/711 |
| 2007/0279302 | A1 * | 12/2007 | Byrne et al. | 343/713 |
| 2008/0055171 | A1 * | 3/2008 | Noro et al. | 343/715 |
| 2008/0074342 | A1 * | 3/2008 | Lindackers et al. | 343/906 |
| 2010/0231467 | A1 * | 9/2010 | Schnuerer | 343/713 |

* cited by examiner

*Primary Examiner* — Hoanganh Le
(74) *Attorney, Agent, or Firm* — GE Global Patent Operation; John A. Kramer

(57) ABSTRACT

In one embodiment, a radio communication system comprises a removable antenna platform and an antenna interface bulkhead connected to a roof of a locomotive. The antenna platform includes a blind mate connector connected to an antenna mount. The antenna mount is connected to a ground plane. The antenna interface bulkhead includes a blind mate connector configured to mate with the blind mate connector of the antenna platform when the antenna platform is attached to the antenna interface bulkhead. The antenna interface bulkhead is configured to attach to the antenna platform in one orientation. Thus, one or more antennas may be quickly attached to or removed from the roof of the locomotive reducing maintenance time for the locomotive when an antenna upgrade may be desired.

9 Claims, 5 Drawing Sheets

SYSTEM AND APPARATUS FOR LOCOMOTIVE RADIO COMMUNICATIONS

FIELD

The subject matter disclosed herein relates to an apparatus for locomotive radio communications.

BACKGROUND

A locomotive or other rail vehicle may be equipped with a radio communication system including a radio in a cab of the locomotive and an antenna mounted on a roof of the locomotive. The radio communication system may include one or more radios using one or more antennas, such as when transmitting and receiving voice and data communications with different radios. The configuration of radio communication systems may change during the lifetime of a locomotive due to technological or regulatory concerns. For example, the radio communication system may be regulated by a governmental agency and the regulations may change. As another example, it may be desirable to add a new radio and/or antenna as radio technology improves or if new radio spectrum becomes available. Thus, radios and their associated antennas may be added and/or removed during the lifetime of the locomotive. One solution for adding an antenna to a locomotive includes finding a suitable location for the antenna on the roof of the locomotive, drilling an access hole in the roof, running cable from the antenna to the radio, and securely fastening the antenna to the roof of the locomotive. This solution may be time consuming and costly due to labor costs and non-productive maintenance time of the locomotive. In addition, the mounting area of the antenna may be subject to water intrusion, which may result in damaged equipment and/or require further maintenance time.

BRIEF DESCRIPTION OF THE INVENTION

An apparatus for locomotive radio communications is provided for removably electrically connecting antennas to a roof of the locomotive. In one embodiment, the radio communication system comprises a removable antenna platform and an antenna interface bulkhead connected to the roof of the locomotive. The antenna platform includes a first blind mate connector connected to an antenna mount. The antenna mount is connected to a ground plane. The antenna interface bulkhead includes a second blind mate connector configured to mate with the blind mate connector of the antenna platform when the antenna platform is attached to the antenna interface bulkhead. The antenna interface bulkhead and antenna platform are configured to attach to one another in one orientation only. Thus, one or more antennas may be quickly attached to or removed from the roof of the locomotive, reducing maintenance time for the locomotive when an antenna upgrade may be desired. In addition, water intrusion may be reduced by reducing the number of holes in the roof of the locomotive and by forming a water resistant seal at the antenna interface bulkhead.

This brief description is provided to introduce a selection of concepts in a simplified form that are further described herein. This brief description is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure. Also, the inventor herein has recognized any identified issues and corresponding solutions.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
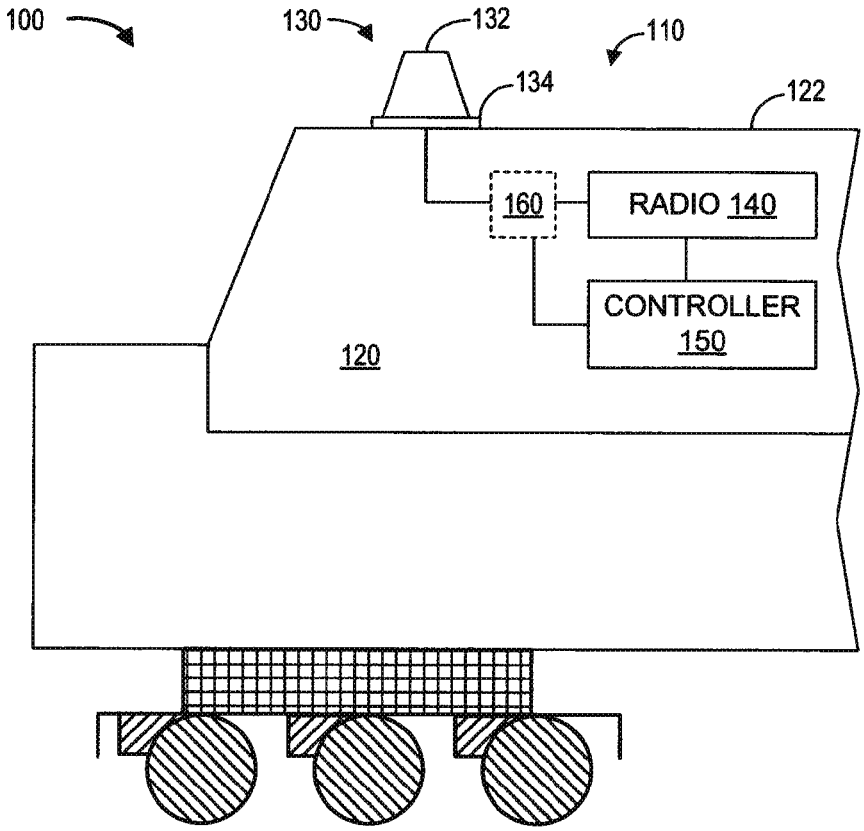
FIG. 1 shows an example embodiment of a locomotive including an antenna platform mounted on the roof of the locomotive.
Figure 2:
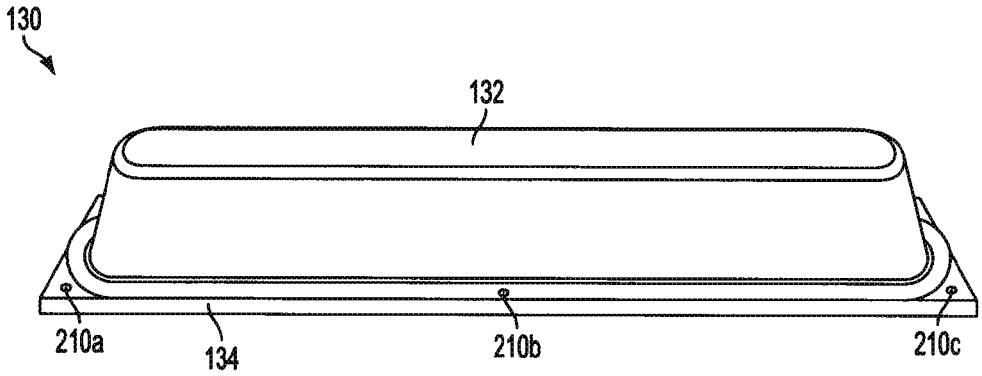
FIG. 2 shows a view of an example embodiment of the antenna platform including an antenna dome.
Figure 3:
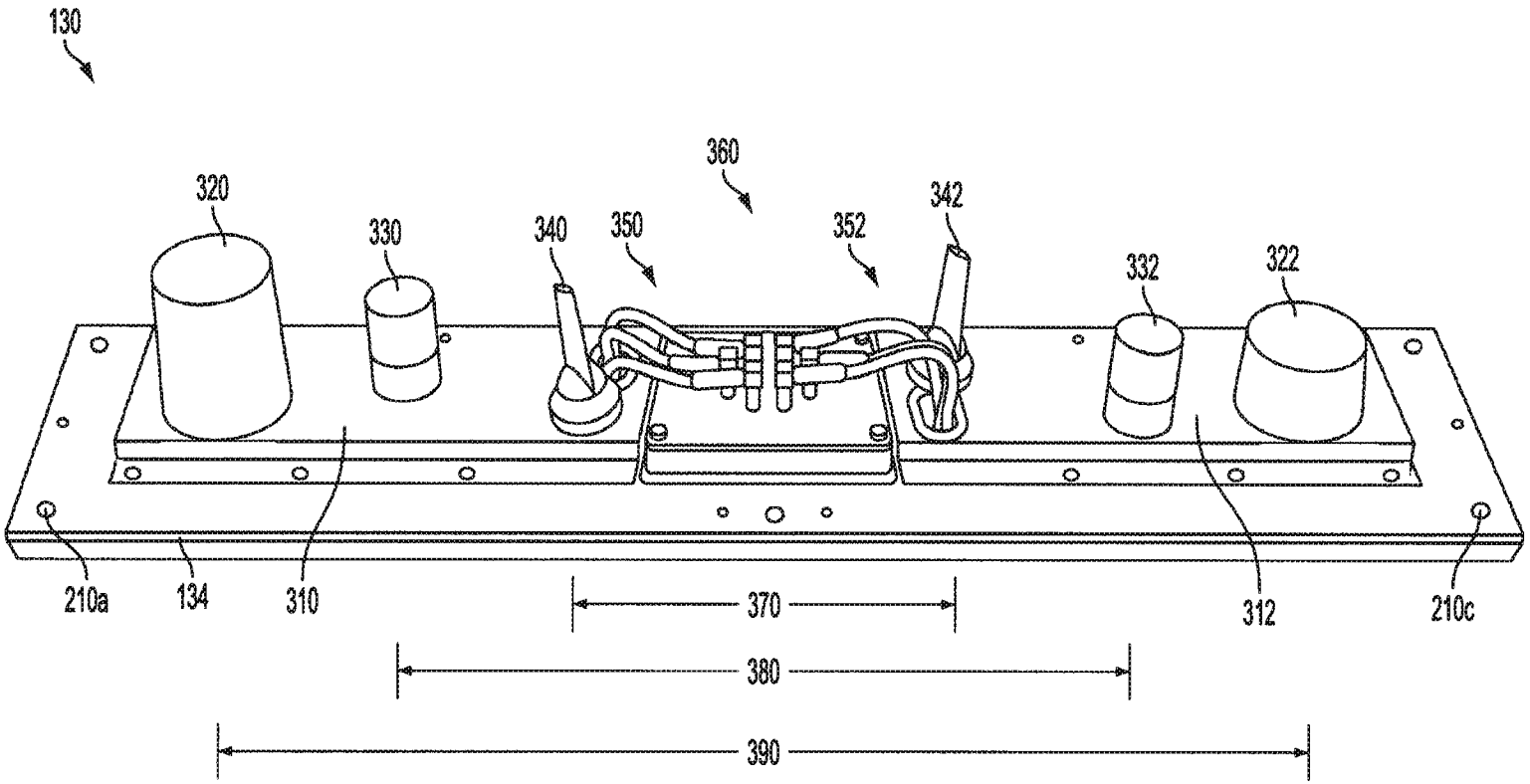
FIG. 3 shows a view of an example embodiment of the antenna platform with the antenna dome removed.
Figure 4:
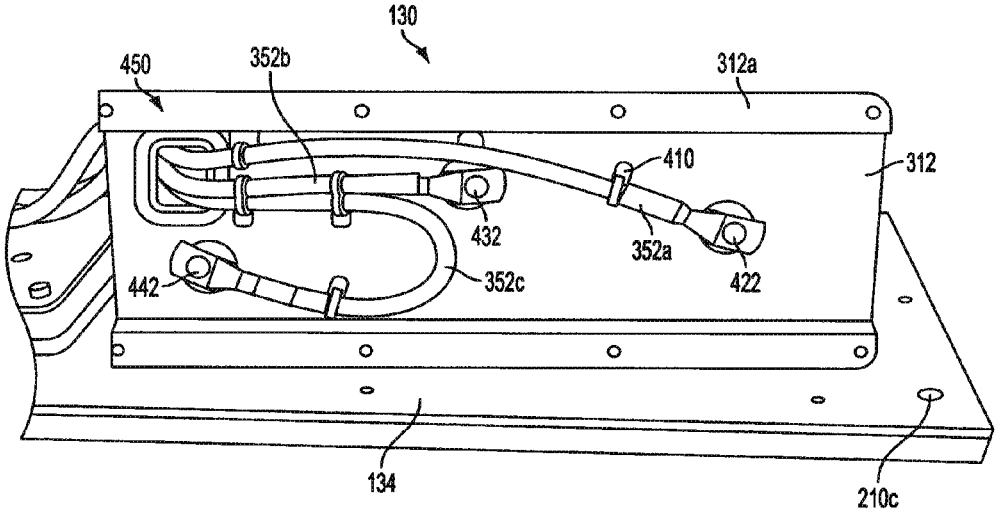
FIG. 4 shows an example embodiment of wiring of antennas to an antenna interface of the antenna platform.
Figure 5:
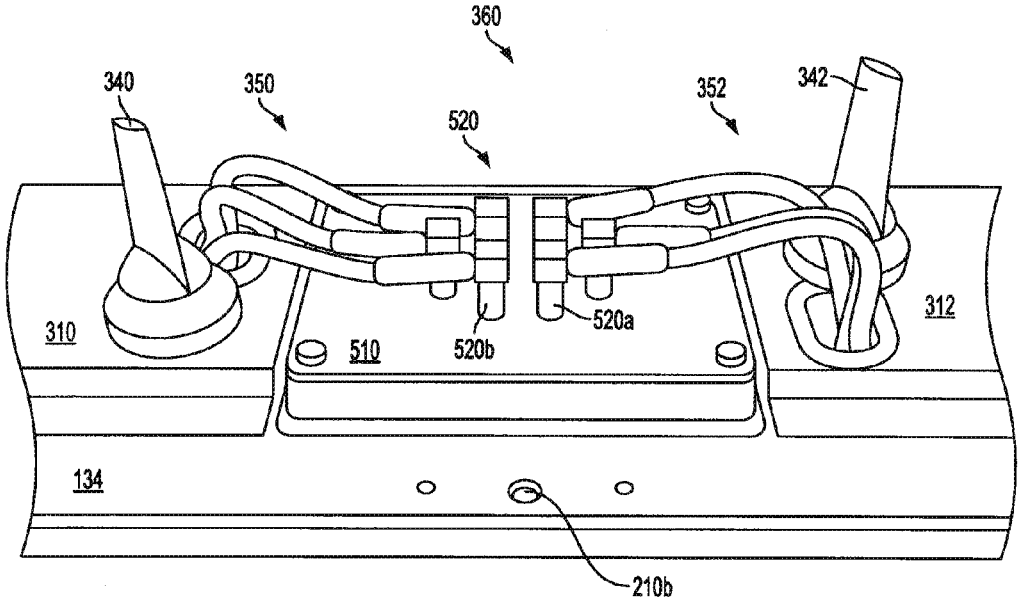
FIG. 5 shows an example embodiment of the antenna interface of the antenna platform.
Figure 6:
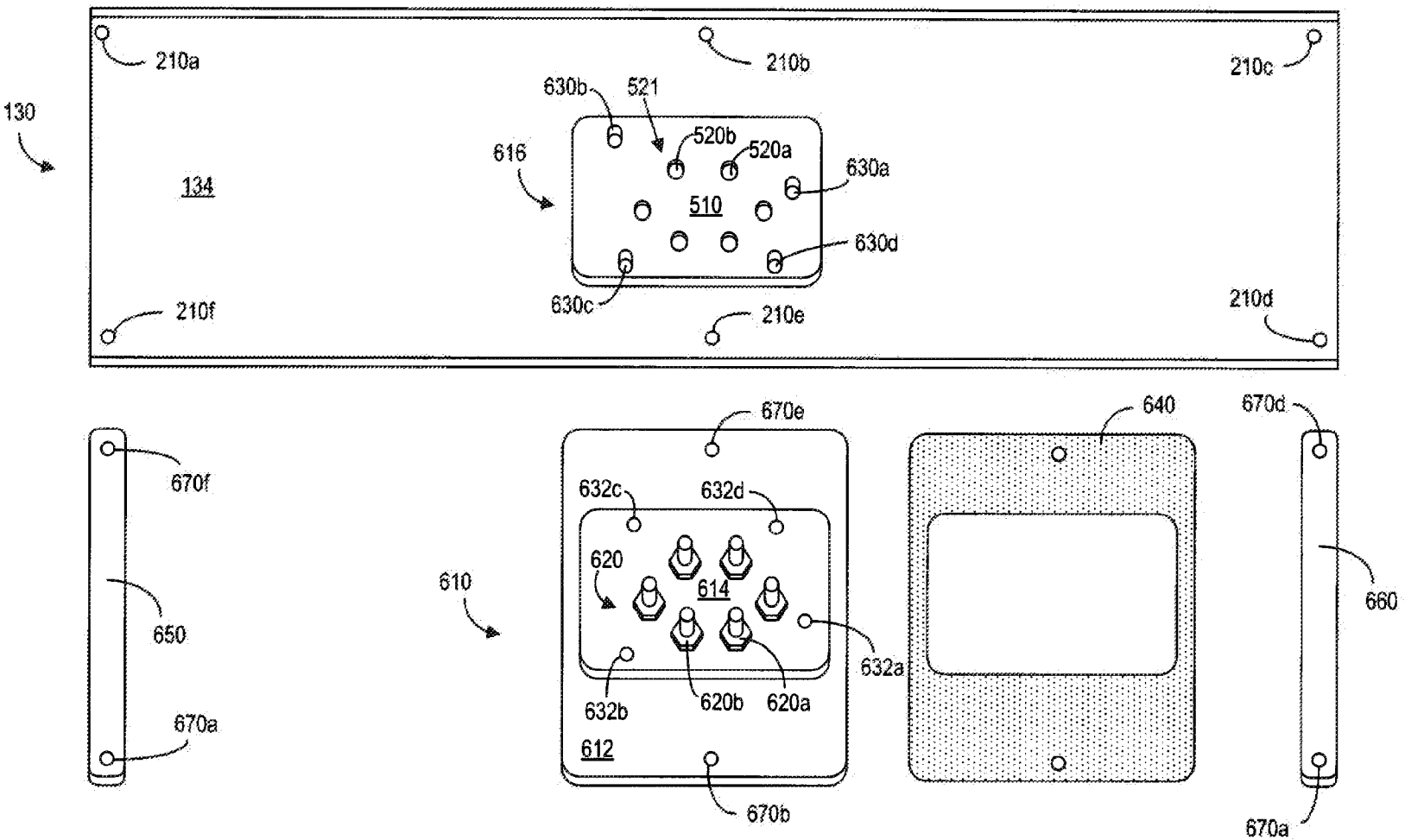
FIG. 6 shows an example embodiment of an antenna interface bulkhead and mounting hardware for connecting the antenna platform to the roof of the locomotive and the antenna interface bulkhead.

FIG. 1 illustrates an example embodiment of a vehicle, specifically, a rail vehicle such as a locomotive, comprising a radio communication system including one or more radios using one or more antennas. An antenna may be mounted on a common antenna platform which may be attached to a roof of the locomotive. The antenna may be connected to a radio in a cab of the locomotive by an antenna interface mounted to the roof of the locomotive. The antenna platform may include an antenna dome that may protect the antenna and the antenna interface from the environment. FIG. 2 shows a view of an example embodiment of the antenna platform including an antenna dome. FIG. 3 shows a view of an example embodiment of the antenna platform with the antenna dome removed. The antenna platform may include a plurality of antennas that are connected to an antenna interface. FIG. 4 shows an example embodiment of cabling between antennas and the antenna interface, and FIG. 5 shows an example embodiment of the antenna interface. The antenna interface may be used to connect the antenna platform to an antenna interface bulkhead on the roof of the locomotive. FIG. 6 shows an example embodiment of the antenna interface bulkhead and mounting hardware for connecting the antenna platform to the antenna interface bulkhead. In this manner, the antenna platform may enable a modular and reconfigurable platform for mounting one or more antennas on the roof of a rail vehicle, such as illustrated in the example embodiment of FIG. 7. The antenna platform may be installed faster than individual antennas may be installed on the roof, and the antenna platform may provide less opportunity for water to intrude through the roof of the locomotive compared to individual antennas. Thus, installing the antenna platform may result in less maintenance time of the locomotive compared to installing individual antennas.

FIG. 1 illustrates an example embodiment of a rail vehicle, herein depicted as locomotive 100. Locomotive 100 may comprise a cab 120 for housing an operator, controls, and electronics that are to be shielded from the elements. Locomotive electronics may include a controller 150 and a radio communication system 110 including a radio 140, an antenna (not shown in this figure), and an optional signal hub 160. Signal hub 160 may be used as a multiplexor to route signals between a radio and an antenna, or signal hub 160 may be used as a signal splitter, such as when more than one antenna is used to transmit a signal from a radio. Signal hub 160 may be controlled by controller 150 or by the locomotive operator.

Radio communication system 110 may include one or more radios using one or more antennas. Each radio and each antenna may be tuned to operate at a range of frequencies. A radio may include a receiver for receiving radio signals and/or a transmitter for transmitting radio signals. In one embodiment, radio communication system 110 may include a radio, such as radio 140, and an antenna for two-way voice communications between the locomotive operator and a control center of a railroad. For example, voice communications may be transmitted and received by a radio centered at a 220 MHz frequency in the very high frequency (VHF) band. As another example, voice communications may be transmitted and received by a radio using the 800 MHz and/or 1900 MHz frequency bands, such as used for cellular communications. In another example, multiple radios may be used to provide redundant communications channels.

In one embodiment, radio communication system 110 may include a radio and an antenna for data communications. The data communications may be between locomotive 100 and a control center of a railroad, another locomotive, a satellite, and/or a wayside device, such as a railroad switch. For example, locomotive 100 may be in communication with a second locomotive that is coupled with locomotive 100. Locomotives may exchange operational parameters, such as engine speed, engine temperature, and fuel level, for example. The 802.11 wireless standard may provide an inexpensive communication protocol for communicating with a device in close proximity, such as a coupled locomotive. Thus, radio communication system 110 may include an 802.11 radio and an antenna for receiving signals centered at 2450 MHz (which is the designated frequency for the 802.11 standard). Data communications between more remote devices may be transmitted and received by a radio in the VHF band or by a cellular radio using the 800 MHz and/or 1900 MHz frequency bands, for example. In one embodiment, locomotive 100 may include a Global Positioning System (GPS) receiver and an antenna for receiving signals centered at 1575.42 MHz and/or other designated GPS frequencies.

In one example, locomotive 100 comprises a controller 150 that may include a computer control system. The locomotive control system may further comprise computer readable storage media including code for enabling an on-board monitoring of locomotive operation. Controller 150, overseeing locomotive systems control, communications, and management, may be configured to receive signals from a variety of sensors in order to estimate locomotive operating parameters. For example, controller 150 may estimate geographic coordinates of locomotive 100 using signals from a GPS receiver. As another example, controller 150 may estimate the speed of locomotive 100 from a speed sensor. Controller 150 may control an engine of locomotive 100, in response to operator input, by sending a command to various engine control hardware components such as inverters, alternators, relays, fuel injectors, fuel pumps, etc. (not shown).

In one embodiment, controller 150 may include instructions for implementing a positive train control (PTC) system. The PTC system may be used for monitoring and controlling locomotive 100 in a desired manner. For example, wayside signal information may be communicated from a wayside device to locomotive 100. Under some circumstances, such as if locomotive 100 is being operated in an undesired manner, the PTC system may automatically control locomotive 100 by overriding operator control of locomotive 100. In one example, the PTC system may maintain the speed of locomotive 100 within a speed limit for a section of track. The speed limit may be communicated from a wayside device or the speed limit may be determined based on a geographic location of locomotive 100. The PTC system may determine the geographic location of locomotive 100 from GPS data received by the GPS receiver. The geographic location may be used as an index to a database to determine a speed limit associated with the geographic location. The database may be stored locally on controller 150 or the database may be stored on a remote server and accessed by sending requests and receiving responses through radio communication system 110. Controller 150 may compare the estimated speed of locomotive 100 to the speed limit of the section of track at the geographic location. If the estimated speed exceeds the speed limit, the PTC system may apply a brake of locomotive 100 or reduce a throttle setting to maintain a reduced speed for locomotive 100.

It may be desirable for a locomotive with a PTC system to have multiple upgradeable radios and antennas. For example, redundant communication channels may be desirable so that time sensitive information may be delivered to the PTC system in a timely manner, even when a radio fails or is out of range of a signal. As another example, it may be desirable to add and/or upgrade radios and antennas due to changing governmental regulations and/or advances in radio technology.

An antenna platform 130 may be used to attach one or more antennas to locomotive 100. For example, antenna platform 130 may include a mounting plate 134 for attaching antenna platform 130 to a roof 122 of locomotive 100. Roof 122 may be constructed of a conductive metal, such as steel, and may be part of (or at least electrically connected to) a chassis of locomotive 100. In one example, an antenna may be mounted on antenna platform 130 instead of attaching the antenna directly to roof 122. Antenna platform 130 may include an area for mounting multiple antennas and an antenna interface for connecting each antenna to cables in cab 120 of locomotive 100. The antennas and the antenna interface may be shielded by an antenna dome 132 from the elements.

Antenna platform 130 may be quickly detached from locomotive 100, as detailed herein, to perform maintenance and/or to add antennas and/or to upgrade antennas. FIG. 2 illustrates an example embodiment of antenna platform 130 that may be detached from locomotive 100. Antenna platform 130 includes mounting plate 134 and antenna dome 132. Antenna dome 132 may be suitably shaped to cover the antennas and the antenna interface on roof 122. Antenna dome 132 may be water resistant and transmissive to radio waves at the frequencies received and transmitted by the antennas. In one example, antenna dome 132 may be transmissive to radio waves from the lower end of the VHF band (30 MHz) to the upper end of the SHF band (30 GHz). In another example, antenna dome 132 may be transmissive to radio waves from 150 MHz to 3 GHz. As a non-limiting example, antenna dome 132 may be constructed from plastic, fiberglass, or other suitable material. In one embodiment, a watertight gasket may be inserted between antenna dome 132 and mounting plate 134 to resist water intrusion. For example, the watertight gasket may extend around a periphery of antenna dome 132.

Mounting plate 134 may include an electrically conductive material that is electrically connected to a ground of locomotive 100 through the chassis of locomotive 100, by way of the roof 122 or otherwise. Thus, mounting plate 134 may utilize roof 122 of locomotive 100 to establish an efficient counterpoise for the antennas of antenna platform 130. In one embodiment, mounting plate 134 may be unpainted or have unpainted surfaces to increase ground integrity. Mounting plate 134 may include holes, such as holes 210*a*, 210*b*, and 210*c*, for inserting fasteners, such as bolts, to attach antenna platform 130 to locomotive 100. In one example, six holes may be used for attaching antenna platform 130 to locomotive 100. Decreasing the attachment points may increase the speed at which a maintenance technician may remove antenna platform 130. Increasing the attachment points may increase the coupling strength of antenna platform 130 to locomotive 100. In one embodiment, bolts inserted into holes of mounting plate 134 may attach mounting plate 134 to locomotive 100 and antenna dome 132 to mounting plate 134.

FIG. 3 illustrates an example embodiment of antenna platform 130 with antenna dome 132 removed. An antenna platform may include an antenna interface and an antenna rail for mounting one or more antennas. In one embodiment, antenna platform 130 includes antenna interface 360, antenna rails 310 and 312, and antennas 320, 322, 330, 332, 340, and 342. In one embodiment, antenna platform 130 includes two antenna rails. However, alternative embodiments of antenna platform 130 may include more or fewer antenna rails. In one embodiment, antenna rails 310 and 312 may each include antenna mounts for three antennas. Thus, in one embodiment, antenna platform 130 may include at least six antenna mounts. However, more or fewer antennas may be mounted on each antenna rail. In another embodiment, antenna platform 130 may include at least four antenna mounts. The number of antenna rails and the number of antennas mounted on each rail may be determined based on the desired number of antennas for radio communication system 110 and/or the desired weight and/or size of antenna platform 130. For example, the number of radios and the communication protocols supported by radio communication system 110 may determine the number of antennas included on antenna platform 130.

In one embodiment, antenna rail 310 may include an NMO mount for connecting each antenna. An NMO mount provides a standard attachment interface (having a 1⅛ inch 18-pitch threaded connector) and may enable an antenna to be attached to antenna rail 310 by screwing the antenna to the NMO mount. Similarly, an antenna may be removed by unscrewing the antenna from the NMO mount of antenna rail 310. Thus, an antenna may be added to or removed from antenna platform 130 quickly and with a minimal set of tools. In one embodiment, an antenna may include a waterproof gasket to reduce water intrusion at the base of the antenna when the antenna is attached to the NMO mount. In alternative embodiments, UHF, BNC, or other suitable mounts may be used for mounting antennas and/or the antennas may be directly mounted, such as by soldering, to antenna rail 310.

Antenna rail 310 may include a conductive material and be electrically connected to a radio frequency (RF) ground. For example, antenna rail 310 may be electrically connected to mounting plate 134 which may be electrically connected to the chassis of locomotive 100. In this manner, antenna rail 310 may act as a ground plane for the antennas connected to antenna rail 310. In one example, antenna rail 310 may be plated with an electrically conductive material. Antenna rail 310 may include an unpainted surface around each antenna mounting surface and at the interface to mounting plate 134 to ensure ground integrity. In one embodiment, an antenna rail may be integral to mounting plate 134. Thus, a mounting plate may include one or more antenna mounts. Each antenna mount is terminated to an interconnect cable, such as cables 350 and 352, which provides a transmission path to antenna interface 360.

The width of antenna interface 360 and the spacing between antenna mounting points may provide physical separation between different antennas attached to antenna platform 130. For example, spatial diversity may be used to increase the quality of a received or transmitted signal. Spatial diversity may be employed when two or more similar antennas are physically separated by at least one wavelength of the frequency being received or transmitted. In one embodiment, spatial diversity may be enabled by spacing the antenna mounts at least one wavelength apart. In an alternate embodiment, spatial diversity may be realized by spacing the antenna mounts between one wavelength and four wavelengths apart. The wavelength of an electromagnetic or radio wave is inversely proportional to the frequency of the radio wave. Thus, higher frequency antennas may be placed closer to each other than lower frequency antennas.

In an embodiment, antennas 340 and 342 are 802.11 antennas. The 802.11 antennas 340 and 342 operate at a central frequency of 2450 MHz having a wavelength of 4.8 inches. Thus, 802.11 antennas 340 and 342 may be separated by more than 4.8 inches. In one embodiment, 802.11 antennas 340 and 342 may be installed on the antenna mounts closest to antenna interface 360 and distance 370 (the distance between the 802.11 antennas 340 and 342) may be greater than five inches. In an alternate embodiment, 802.11 antennas 340 and 342 may be installed on the antenna mounts closest to antenna interface 360 and distance 370 may be greater than five inches and less than eighteen inches. However, spatial diversity may be enabled if 802.11 antennas 340 and 342 are installed on any of the antenna mounts that are separated by more than 4.8 inches. In one embodiment 802.11 antennas 340 and 342 may have a fifty ohm characteristic impedance.

In an embodiment, antennas 330 and 332 are cell antennas. Each cell antenna 330 and 332 may receive and transmit frequencies at 1900 MHz and/or 800 MHz. The wavelengths of 1900 MHz and 800 MHz radio waves are 6.2 inches and 14.8 inches, respectively. Thus, cell antennas 330 and 332 may be separated by more than 14.8 inches. In one embodiment, cell antennas 330 and 332 may be installed on the antenna mounts in the middle of antenna rails 310 and 312, respectively, and distance 380 (the distance between the cell antennas 330 and 332) may be greater than fifteen inches. In an alternate embodiment, cell antennas 330 and 332 may be installed on the antenna mounts in the middle of antenna rails 310 and 312, respectively, and distance 380 may be greater than fifteen inches and less than twenty-four inches. In one embodiment cell antennas 330 and 332 may have a fifty ohm characteristic impedance.

In an embodiment, antenna 320 is a VHF antenna. VHF antenna 320 may receive and transmit frequencies at 220 MHz with a wavelength of 53.6 inches. Thus, multiple VHF antennas may be separated by more than fifty-four inches. In one embodiment, VHF antenna 320 may be installed on an antenna mount farthest from antenna interface 360. For example, VHF antenna 320 may be installed on the antenna mount of antenna rail 310 farthest from antenna interface 360. In one embodiment, distance 390 (the distance from the VHF antenna 320 to the opposite side of the platform 130) may be greater than or equal to fifty-four inches and a second VHF antenna may be installed on the antenna mount of antenna rail 312 farthest from antenna interface 360. However, it may be desirable to decrease a width of mounting plate 134 to reduce the weight, cost, or wind-load of antenna platform 130. Thus, in one embodiment, distance 390 may be greater than fifteen inches and less than fifty-four inches. Spatial diversity may be enabled for the VHF frequency by adding a second VHF antenna spaced more than fifty-four inches from antenna platform 130. For example, locomotive 100 may include multiple antenna platforms or a VHF antenna may be separately mounted on roof 122. In alternate embodiments, there may be a single VHF antenna and spatial diversity will not be enabled for VHF frequencies. In one embodiment VHF antenna 320 may have a fifty ohm characteristic impedance.

In another embodiment, antenna 322 is a GPS antenna. GPS antenna 322 receives frequencies at a central frequency of 1575.42 MHz with a wavelength of 7.5 inches. Thus, multiple GPS antennas may be separated by more than 7.5 inches. In one embodiment, GPS antenna 322 may be installed on an antenna mount farthest from antenna interface 360. For example, GPS antenna 322 may be installed on the antenna mount of antenna rail 312 farthest from antenna interface 360. If spatial diversity is desired for receiving GPS, locomotive 100 may include multiple antenna platforms or a GPS antenna may be separately mounted on roof 122, for example. In one embodiment GPS antenna 322 may have a fifty ohm characteristic impedance.

By including antenna mounts at suitable spacings, antenna platform 130 may reduce or prevent errors compared to technicians manually installing antennas. For example, a technician manually installing antennas on roof 122 may inadvertently install antennas too close to enable spatial diversity, especially for the longer wavelength antennas, such as the VHF antenna. However, antenna platform 130 may include predefined spacings between each antenna mount reducing the likelihood of an error by a technician installing an antenna.

Signals received by an antenna may be transmitted to a radio. Similarly, signals generated by a radio may be transmitted by an antenna. The signal to noise ratio of a signal may be increased when the loss through the transmission path between the radio and the antenna is decreased. Transmission loss may be reduced when the characteristic impedance of the antennas, cables, and connectors in the transmission path are matched, such as when each component has a characteristic impedance of fifty ohms, for example. In one embodiment, the transmission path may include a cable between the antenna and antenna interface 360, antenna interface 360, an antenna interface bulkhead, and a cable between the antenna interface bulkhead and radio 140. Antenna interface 360 and the antenna interface bulkhead may form a blind mate connection when antenna platform 130 is attached to locomotive 100. The blind mate connection may provide a low loss transmission path and enable antenna platform 130 to be quickly installed on or removed from locomotive 100. FIGS. 4-6 show aspects of the transmission path between antennas and radios that may reduce losses and enable quick installation and/or removal of antenna platform 130. Specifically, FIG. 4 shows connectors and cables from antennas to antenna interface 360. FIG. 5 shows cables connecting to a front side of antenna interface 360. FIG. 6 shows connectors on a back side of antenna interface 360 and a roof side of the antenna interface bulkhead. The connectors on the back side of antenna interface 360 join, or mate, with connectors of the antenna interface bulkhead to form a blind mate connection when antenna platform 130 is attached to locomotive 100.

Returning to the figures, FIG. 4 illustrates an example embodiment of a back side of antenna rail 312 showing cabling between antennas and antenna interface 360. Antenna rail 312 may include antenna mounts 422, 432, and 442 for attaching antennas 322, 332, and 342, respectively. In one embodiment, each of antenna mounts 422, 432, and 442 may be an NMO mount including an M-type mount for connecting the antenna and an SMA connector for attaching to a cable. Cables 352*a*, 352*b*, and 352*c* provide a transmission path for signals from antennas 322, 332, and 342, respectively, to antenna interface 360. Cables 352*a*, 352*b*, and 352*c* may be routed along the back side of antenna rail 312 to an exit point 450 of antenna rail 312 and then to antenna interface 360. Each of the cables may be clipped to the back side of antenna rail 312 with clips, such as clip 410, for example. Clipping the cables to antenna rail 312 may reduce the likelihood of a cable becoming disconnected and/or wearing prematurely when antenna platform 130 is subjected to locomotive operational conditions, such as vibration. In one embodiment each cable may be a coaxial cable with a fifty ohm characteristic impedance.

Antenna rail 312 may include a flange, such as flange 312*a*. Flange 312*a* may include an unpainted surface that may directly contact an unpainted surface of mounting plate 134 when antenna platform 130 is assembled. Increasing the surface area of flange 312*a* may reduce the impedance between mounting plate 134 and antenna rail 312 which may increase the integrity of ground at RF frequencies. As non-limiting examples, antenna rail 312 may be screwed, soldered, or attached by another suitable fastener when antenna platform 130 is assembled.

FIG. 5 shows an example embodiment of a front side of antenna interface 360. Antenna interface 360 provides the transmission path for signals between antenna platform 130 and locomotive 100. Specifically, antenna interface 360 provides the transmission path for signals between the antennas of antenna platform 130 and the antenna interface bulkhead on roof 122 of locomotive 100. In one embodiment, antenna interface 360 includes an interface mounting plate 510 and one or more extenders 520 (e.g., extenders 520*a*, 520*b*) attached to and extending through interface mounting plate 510. Interface mounting plate 510 may be attached to mounting plate 134. In an alternate embodiment, interface mounting plate 510 may be integral with mounting plate 134. Interface mounting plate 510 may include a conducting material. The number of extenders 520 may be greater than or equal to the number of antennas of antenna platform 130. A first end of each extender 520 includes a connector for connecting to a cable from an antenna. Thus, extenders 520 may be connected to cables 350 and 352. In one embodiment, each extender 520 includes a first end with an SMA connector. In one embodiment, each extender 520 has a characteristic impedance of fifty ohms. As should be appreciated, the one or more extenders 520 provide respective discreet electrical pathways through the mounting plate 510 for the cables 350 and 352. The antenna interface 360 may include plural extenders 520*a*, 520*b* as shown in the drawings, or the antenna interface 360 may include a single, integrated extender unit that has plural connectors for connecting the cables 350 and 352.

Each extender 520 includes a second end on the opposite of interface mounting plate 510 as illustrated in FIG. 6, which shows an example embodiment of antenna interface bulkhead 610 and mounting hardware for connecting antenna platform 130 to roof 122 of locomotive 100 and antenna interface bulkhead 610. The second end of each extender 520 may include a blind mate connector 521 for connecting to antenna interface bulkhead 610. Antenna interface bulkhead 610 provides a transmission path for signals to propagate between the antennas of antenna platform 130 and radios of locomotive 100. Antenna interface bulkhead 610 may include a roof mounting plate 612, a bulkhead plate 614, and one or more blind mate connectors 620 (e.g., connectors 620*a*, 620*b*).

Roof mounting plate 612 may be attached to roof 122 in such a manner that a periphery of roof mounting plate 612 extends around a periphery of a hole in roof 122. (See FIG. 7 for a cross-section view that shows the roof hole and other holes referred to herein.) Roof mounting plate 612 may be welded to roof 122 or attached to roof 122 with suitable fasteners, such as screws, bolts, rivets, etc. Roof mounting plate 612 includes a hole for routing one or more cables to signal hub 160 or to radios, such as radio 140, for example. The hole in roof mounting plate 612 may be covered by bulkhead plate 614 when bulkhead plate 614 is attached to roof mounting plate 612. In an alternate embodiment, bulkhead plate 614 may be integral with roof mounting plate 612. Roof mounting plate 612 and bulkhead plate 614 may include a conductive material. Thus, roof mounting plate 612 and bulkhead plate 614 may be electrically connected to the chassis of locomotive 100. It may be desirable to remove paint on roof 122 where roof mounting plate 612 attaches to roof 122 to decrease the impedance between roof mounting plate 612 and roof 122. The interface between roof mounting plate 612 and roof 122 may be sealed to reduce or prevent water intrusion into cab 120 from the hole in roof 122. Sealing may include welding and/or caulking around the periphery of roof mounting plate 612. The hole in roof 122 may be used for transmission between multiple antennas and multiple radios and so fewer holes in roof 122 may be needed than in a conventional installation with one hole per antenna. Thus, there may be fewer areas for water to intrude compared to a conventional installation with one hole per antenna.

Each blind mate connector 620 may be connected to bulkhead plate 614 and a cable which may be threaded through the hole in roof 122 and connected to radio 140 or signal hub 160 in cab 120 of locomotive 100. When antenna platform 130 is attached to antenna interface bulkhead 610, the blind mate connectors 620 connect, or mate, to the blind mate connectors 521 of extenders 520, forming a low loss transmission path from antennas of antenna platform 130 into locomotive 100. Blind mate connectors 620 and the blind mate connectors 521 of extender 520 have opposite genders. In one embodiment, the blind mate connectors 620 are male and the blind mate connectors 521 of extenders 520 are female. In an alternate embodiment, blind mate connectors 620 are female and the blind mate connectors 521 of extenders 520 are male. The alignment of each blind mate connector determines which antenna may be connected with each cable in cab 120. For example, the end of extender 520*a* (forming part of and/or electrically connected to a blind mate connector 521) aligns with blind mate connector 620*a* when antenna platform 130 is attached to antenna interface bulkhead 610. Thus, the antenna connected to extender 520*a* may be connected to the cable connected to blind mate connector 620*a*. Similarly, extender 520*b* aligns with blind mate connector 620*b* when antenna platform 130 is attached to antenna interface bulkhead 610. Thus, the antenna connected to extender 520*b* may be connected to the cable connected to blind mate connector 620*b*. The cable connected to blind mate connector 620*b* may be a coaxial cable with a characteristic impedance of fifty ohms. The cable may vary from a few inches long to many feet long. In one embodiment, the cable may be twenty-five feet long and thus, the cable may be directly connected to radio 140 or signal hub 160. In another embodiment, the cable may be eighteen inches long and thus, the cable may be connected to radio 140 or signal hub 160 by a second cable.

As should be appreciated, in an embodiment, the antenna interface bulkhead 610 includes one or more first blind mate connectors 620, and the antenna platform 130 includes one or more second blind mate connectors 521. The first blind mate connector(s) 620 and the second blind mate connector(s) 521 are aligned and configured so that when the antenna platform is attached to the antenna interface bulkhead, respective aligning first and second blind mate connectors detachably mate with one another for establishing an electrical connection between a cable connected to the first blind mate connector and a cable connected to the second blind mate connector, and thereby an electrical connection between an antenna and a radio or other electronic device in the locomotive.

The arrangement of blind mate connectors 620 of the antenna platform 130 may form a pattern. Similarly, the arrangement of blind mate connectors 521 of extenders 520 may form a corresponding pattern. In one embodiment, the arrangement of blind mate connectors 620 and 521 may each form a hexagonal pattern. Other non-limiting examples of patterns may include square, circular, rectangular, or other suitable patterns. The alignment of blind mate connectors 620 to blind mate connectors 521 determines which antenna may be connected with each cable in cab 120. Thus, it may be desirable to attach antenna platform 130 in a known orientation so that it is known which antenna is connected with each cable in cab 120. Antenna interface 360 and antenna interface bulkhead 610 may be mechanically keyed so that antenna interface 360 may fit onto antenna interface bulkhead 610 in a single orientation only. In other words, antenna interface bulkhead 610 may be configured to attach to antenna interface 360 of antenna platform 130 in one orientation. In one embodiment, a hole 616 of mounting plate 134 may be configured to fit onto bulkhead plate 614 in a single orientation. For example, hole 616 of antenna platform 130 may be shaped to receive bulkhead plate 614. In one embodiment, bulkhead plate 614 may include a chamfer on one corner and hole 616 may extend around the chamfer so that hole 616 may fit onto bulkhead plate 614 in a single orientation. Antenna interface 360 may include one or more pins, which may fit into one or more holes of antenna interface bulkhead 610 when antenna platform 130 is in a desired orientation. For example, antenna interface 360 may include one or more pins arranged in an asymmetric pattern, which align with one or more holes of antenna interface bulkhead 610 when antenna platform 130 is in a desired orientation. When the pins and the holes are misaligned, antenna platform 130 cannot be attached to locomotive 100 because the pins will not slide into the holes. When the pins and holes are aligned, antenna platform 130 may be attached to locomotive 100 because the pins will slide into the holes.

In one embodiment, antenna interface 360 may include a pin 630*a* for inserting into a hole 632*a* of antenna interface bulkhead 610 in one orientation (of the antenna interface 360 with respect to the antenna interface bulkhead 610) only. In another embodiment, antenna interface 360 may include a plurality of pins for inserting into a plurality of holes of antenna interface bulkhead 610 in one orientation only. For example, antenna interface 360 may include four pins, such as 630*a*-630*d*, for inserting into four holes, such as 632*a*-632*d*, respectively, of antenna interface bulkhead 610 in one orientation only. Thus, antenna interface 360 may fit onto antenna interface bulkhead 610 when pin 630*a* aligns with hole 632*a*, pin 630*b* aligns with hole 632*b*, pin 630*c* aligns with hole 632*c*, and pin 630*d* aligns with hole 632*d*. It may be desirable for the plurality of holes and the plurality of pins to extend around a periphery of the blind mate connectors to reduce the potential risk of the plurality of pins damaging the blind mate connectors if antenna platform 130 is misaligned. In an alternate embodiment, antenna interface 360 may include one or more holes keyed to one or more pins of antenna interface bulkhead 610 so that antenna platform 130 may be attached to antenna interface bulkhead 610 in one orientation.

A RF gasket 640 may be inserted between antenna platform 130 and antenna interface bulkhead 610 to reduce or prevent water intrusion and to electrically connect antenna platform 130 and antenna interface bulkhead 610. In one embodiment, RF gasket 640 may include a hole generally in the shape of bulkhead plate 614 and holes to pass fasteners between mounting plate 134 and antenna interface bulkhead 610. In an alternative embodiment, RF gasket 640 may extend around a periphery of antenna interface bulkhead 610. Non-limiting examples of RF gasket 640 may include conductive elastomers or conductive foam.

One or more brackets, such as brackets 650 and 660, may be attached to roof 122 for attaching antenna platform 130 to locomotive 100. In one embodiment, bracket 650 may include conductive material so bracket 650 may be electrically connected to the chassis of locomotive 100. It may be desirable to remove paint on roof 122 where bracket 650 attaches to roof 122 to decrease the impedance between bracket 650 and roof 122. In one embodiment, brackets 650 and 660 may be welded to roof 122, but other suitable fasteners may be used. Bracket 650 may guide an edge of antenna platform 130 into position for attaching antenna platform 130 to locomotive 100. Thus, bracket 650 may have a shape that conforms to one or more edges of antenna platform 130. In one embodiment, bracket 650 may be linear for aligning with one edge of antenna platform 130. In an alternate embodiment, bracket 650 may be L-shaped to align with two edges of antenna platform 130. Bracket 650 may include a threaded hole for receiving a fastener, such as a screw or a bolt. If more than one bracket is provided, the brackets may be the same or similar to bracket 650 described above, and similarly connected to roof 122.

Brackets and mechanical keying may enable antenna platform 130 to be quickly aligned in the correct orientation to be attached to locomotive 100. Once in the correct orientation, antenna platform 130 may be attached to antenna interface bulkhead 610 and brackets 650 and 660 with fasteners, such as screws or bolts. For example, holes 210*a-f* may be aligned with threaded holes 670*a-f*, respectively, and bolts may be driven into threaded holes 670*a-f* to attach antenna platform 130 to locomotive 100. In this manner, antenna platform 130 may be attached to locomotive 100 and the antennas of antenna platform 130 may be connected by a low loss transmission path to radios in cab 120, a low impedance path to ground may be formed from antenna rails 310 and 312 to the chassis of locomotive 100, and a water resistant seal may be formed between antenna platform 130 and the hole in roof 122.

Similarly, antenna platform 130 may be quickly removed from locomotive 100 by removing the fasteners holding antenna platform 130 to locomotive 100. For example, it may be desirable to remove a first antenna platform and replace it with a second antenna platform, such as to upgrade the antennas or to replace a faulty antenna. Antenna interface bulkhead 610 may resist water intrusion and so locomotive 100 may operate without an antenna platform attached.

Figure 7:
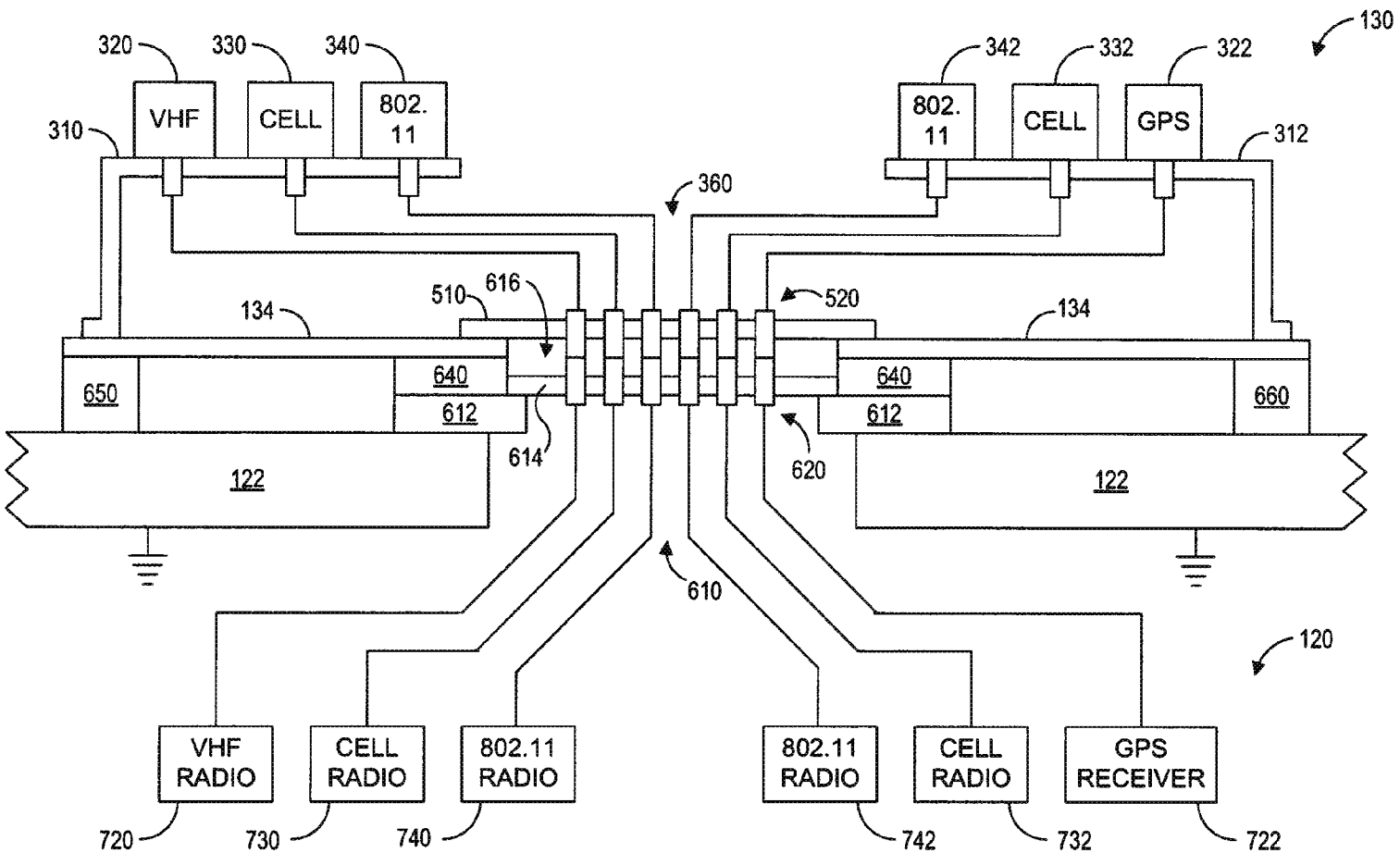
FIG. 7 shows a schematic cross-section of an example embodiment of an antenna platform attached to a locomotive.

FIG. 7 shows a schematic cross-section of one embodiment of antenna platform 130 attached to locomotive 100. Mechanical keying enables antenna interface 360 to align with antenna interface bulkhead 610 in only one orientation when antenna platform 130 is attached to roof 122. Thus, the blind mate connectors 521 of extenders 520 of antenna interface 360 are aligned with blind mate connectors 620 of antenna interface bulkhead 610. In this manner, an antenna mounted on antenna platform 130 may be connected by a transmission path through a hole in roof 122 to an appropriate radio in cab 120 of locomotive 100. For example, VHF antenna 320 may be connected to a VHF radio 720, cell antenna 330 may be connected to a cell radio 730, 802.11 antenna 340 may be connected to a 802.11 radio 740, 802.11 antenna 342 may be connected to a 802.11 radio 742, cell antenna 332 may be connected to a cell radio 732, and GPS antenna 322 may be connected to a GPS receiver 722.

A low impedance RF ground plane may be formed by the mechanical assembly of antenna platform 130 and attachment to locomotive 100. Specifically, antenna rails 310 and 312 may be grounded to roof 122 through the mechanical assembly of plates, brackets, and/or gaskets. For example, an electrically conductive antenna rail 310 may include one or more flanges in face sharing contact with electrically conductive mounting plate 134. Mounting plate 134 may be in face sharing contact with electrically conductive bracket 650 which is in face sharing contact with electrically conductive roof 122 at chassis ground potential. Similarly, antenna rail 312 may be in face sharing contact with mounting plate 134 which is in face sharing contact with roof 122 at chassis ground potential. A combination of electrically conductive plates and an electrically conductive RF gasket may ground interface mounting plate 510 and bulkhead plate 614. For example, interface mounting plate 510 may be in face sharing contact with mounting plate 134 which is in face sharing contact with RF gasket 640 which is in face sharing contact with roof mounting plate 612 which is in face sharing contact with roof 122 at chassis ground potential. Similarly, bulkhead plate 614 may be in face sharing contact with RF gasket 640 and roof mounting plate 612 which is in face sharing contact with roof 122 at chassis ground potential. Thus, impedance of the ground plane of antenna platform 130 may be reduced through multiple pathways to ground and surface area contact to ground that may be greater than a surface area provided by a conventional ground strap.

Certain embodiments of antenna platform 130 may include different configurations of antennas for communicating in different protocols. In one embodiment, antenna platform 130 may include two antennas for communicating via 802.11, and two antennas for communicating via a cellular network. Specifically, antenna platform 130 may include a ground plane and a first 802.11 antenna mounted to the ground plane with a first NMO connector. A second 802.11 antenna may be mounted to the ground plane with a second NMO connector and the second 802.11 antenna may be spaced between five and eighteen inches from the first 802.11 antenna. A first cell antenna may be mounted to the ground plane with a third NMO connector. A second cell antenna may be mounted to the ground plane with a fourth NMO connector and the second cell antenna may be spaced between fifteen and twenty-four inches from the first cell antenna. An antenna interface may include a first blind mate connector connected to the first 802.11 antenna by a first coaxial cable between the first NMO connector and the first blind mate connector. A second blind mate connector may be connected to the second 802.11 antenna by a second coaxial cable between the second NMO connector and the second blind mate connector. A third blind mate connector may be connected to the first cell antenna by a third coaxial cable between the third NMO connector and the third blind mate connector. A fourth blind mate connector may be connected to the second cell antenna by a fourth coaxial cable between the fourth NMO connector and the fourth blind mate connector. The antenna interface may include a plurality of pins (e.g., four pins) arranged in an asymmetric pattern around a periphery of the first, second, third, and fourth blind mate connectors to align with a corresponding plurality of holes (e.g., four holes) of an antenna interface bulkhead.

In another embodiment, antenna platform 130 may include two antennas for communicating via 802.11, and two antennas for communicating via a cellular network, one antenna for receiving a GPS signal, and one antenna for communicating via VHF. Specifically, antenna platform 130 may include a ground plane and a first 802.11 antenna mounted to the ground plane with a first NMO connector. A second 802.11 antenna may be mounted to the ground plane with a second NMO connector and the second 802.11 antenna may be spaced between five and eighteen inches from the first 802.11 antenna. A first cell antenna may be mounted to the ground plane with a third NMO connector. A second cell antenna may be mounted to the ground plane with a fourth NMO connector and the second cell antenna may be spaced between fifteen and twenty-four inches from the first cell antenna. A GPS antenna may be mounted to the ground plane with a fifth NMO connector. A VHF antenna may be mounted to the ground plane with a sixth NMO connector spaced greater than fifteen inches from the GPS antenna. An antenna interface may include a first blind mate connector connected to the first 802.11 antenna by a first coaxial cable between the first NMO connector and the first blind mate connector. A second blind mate connector may be connected to the second 802.11 antenna by a second coaxial cable between the second NMO connector and the second blind mate connector. A third blind mate connector may be connected to the first cell antenna by a third coaxial cable between the third NMO connector and the third blind mate connector. A fourth blind mate connector may be connected to the second cell antenna by a fourth coaxial cable between the fourth NMO connector and the fourth blind mate connector. A fifth blind mate connector may be connected to the GPS antenna by a fifth coaxial cable between the fifth NMO connector and the fifth blind mate connector. A sixth blind mate connector may be connected to the VHF antenna by a sixth coaxial cable between the sixth NMO connector and the sixth blind mate connector. The antenna interface may include a plurality of pins (e.g., four pins) arranged in an asymmetric pattern around a periphery of the first, second, third, fourth, fifth, and sixth blind mate connectors to align with a corresponding plurality of holes (e.g., four holes) of an antenna interface bulkhead. The first blind mate connector, the second blind mate connector, the third blind mate connector, the fourth blind mate connector, the fifth blind mate connector, and the sixth blind mate connector may be arranged in a hexagonal pattern.

In an embodiment, the blind mate connectors 620 and 521 are detachably mated to one another via a press fit, that is, one connector axially slides into and engages another without the need to screw or rotate the connectors.

In an embodiment, the antenna interface bulkhead (connected to the roof of the cab of the locomotive) is a semi-permanent, stand alone installation. Here, the antenna interface bulkhead is separately attached to the cab roof, and does not require the presence of the antenna platform or underlying cables (e.g., cables connecting blind mate connectors 620 to radios 720, 722, 730, 732, 740, 742) to remain securely in place. Thus, when the antenna platform is removed, and/or when underlying cables are removed, the antenna interface bulkhead does not come loose, and there is no substantial effect on the positioning of the antenna interface bulkhead.

Another embodiment relates to a radio communication system for a locomotive or other rail vehicle having a roof or other external surface. The system comprises an antenna platform and an antenna interface bulkhead. The antenna platform comprises a mounting plate, a plurality of antenna mounts connected to the mounting plate and to a ground plane, a plurality of first blind mate connectors respectively connected to the antenna mounts, and a plurality of antennas respectively connected to the plurality of antenna mounts. The plurality of antennas include at least one first antenna configured for wireless communications in a first bandwidth and at least one second antenna configured for wireless communications in a second, non-overlapping bandwidth. That is, the first bandwidth does not overlap the second bandwidth. The antenna interface bulkhead is connected to the roof or other external surface of the locomotive or other rail vehicle. The antenna interface bulkhead includes a plurality of second blind mate connectors configured to respectively mate with the plurality of first blind mate connectors of the antenna platform when the antenna platform is attached to the antenna interface bulkhead. The antenna interface bulkhead and antenna platform are configured to attach to one another in only one orientation. In another embodiment, the system further comprises a plurality of discreet electrical pathways (e.g., coaxial cables) that respectively interconnect the second blind mate connectors to electronic equipment in the locomotive or other rail vehicle.

When a distance or quantity is characterized herein as being "between" a first boundary and a second boundary, this means between and including the first and second boundaries, unless otherwise specified through the provision of language excluding the first and second boundaries. For example, when it is specified that a first distance may be between X inches and Y inches, where $X<Y$ for example, this means: $Y \geqq$ first distance $\geqq X$.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to illustrate the parameters of the invention, they are by no means limiting and are exemplary embodiments, unless otherwise specified. Many other embodiments will be apparent to those of skill in the art upon reviewing the above description. Therefore, the scope of the invention should be determined with reference to the appended claims, along with the full scope of equivalents to which such claims are entitled. In the appended claims, any instances of the terms "including" and "in which" are used as the plain-English equivalents of the respective terms "comprising" and "wherein." Moreover, in the following claims, the terms "first," "second," "third," "fourth," "fifth," "sixth," "front," "back," etc. are used merely as labels, and are not intended to impose numerical or positional requirements on their objects. As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims. Moreover, unless specifically stated otherwise, any use of the terms first, second, etc., do not denote any order or importance, but rather the terms first, second, etc., are used to distinguish one element from another.

The invention claimed is:

1. A radio communication system for a rail vehicle having a cab with a roof, comprising:

an antenna platform including a first blind mate connector connected to an antenna mount, the antenna mount electrically connected to a ground plane;

an antenna mounted to the antenna mount;

an antenna interface bulkhead connected to the roof of the cab of the rail vehicle, the antenna interface bulkhead including a second blind mate connector configured to mate with the first blind mate connector of the antenna platform when the antenna platform is attached to the antenna interface bulkhead, the antenna interface bulkhead and antenna platform configured to attach to one another in only one orientation; and a cable that connects the antenna mount to the first blind mate connector to transmit a signal from the antenna to the antenna bulk head interface.

2. The radio communication system of claim 1, wherein the antenna interface bulkhead includes a bulkhead plate and the antenna platform includes a hole shaped to receive the bulkhead plate.

3. The radio communication system of claim 1, wherein the antenna interface bulkhead includes a plurality of holes and the antenna platform includes a plurality of pins configured to fit into the plurality of holes when the antenna platform is attached to the antenna interface bulkhead.

4. The radio communication system of claim 3, wherein the plurality of holes of the antenna interface bulkhead are arranged in an asymmetric pattern.

5. The radio communication system of claim 3, wherein the plurality of holes of the antenna interface bulkhead extend around a periphery of the second blind mate connector.

6. The radio communication system of claim 1, wherein the antenna mount of the antenna platform is a NMO mount.

7. The radio communication system of claim 1, further comprising a gasket in between the antenna platform and the antenna interface bulkhead, the gasket extending around a periphery of the antenna interface bulkhead.

8. The radio communication system of claim 7, further comprising a conductive bracket connected to the roof of the cab, the antenna platform including a conductive mounting plate connected to a flange of the ground plane, the gasket being an RF gasket, and the mounting plate of the antenna platform is electrically connected to the bracket and the RF gasket when the antenna platform is connected to the antenna interface bulkhead.

9. A radio communication system for a locomotive having a cab with a roof, comprising:

an antenna platform comprising a mounting plate, a plurality of antenna mounts connected to the mounting plate and to a ground plane, a plurality of first blind mate connectors respectively connected to the antenna mounts, and a plurality of antennas respectively connected to the plurality of antenna mounts, wherein the plurality of antennas comprise at least one first antenna configured for wireless communications in a first bandwidth and at least one second antenna configured for wireless communications in a second, non-overlapping bandwidth; and an antenna interface bulkhead configured for connection to the roof of the cab of the locomotive, the antenna interface bulkhead including a plurality of second blind mate connectors configured to respectively mate with the plurality of first blind mate connectors of the antenna platform when the antenna platform is attached to the antenna interface bulkhead, the antenna interface bulkhead and antenna platform configured to attach to one another in only one orientation; and a plurality of cables that respectively connect the plurality of antenna mounts to the plurality of first blind mate connectors to transmit a signal from the plurality of antennas to the antenna interface bulk head.

* * * * *